US007523573B2

(12) United States Patent
Oliviero et al.

(10) Patent No.: US 7,523,573 B2
(45) Date of Patent: Apr. 28, 2009

(54) VIDEO POSTCARD METHOD AND DEVICE

(76) Inventors: Luigi Oliviero, Via Lucio Apuleio, 25, Rome, Lazio (IT) 00136; Maurizio Oliviero, Via Lucio Apuleio, 25, Rome, Lazio (IT) 00136

( * ) Notice: Subject to any disclaimer, the term of this patent is extended or adjusted under 35 U.S.C. 154(b) by 63 days.

(21) Appl. No.: 11/525,487

(22) Filed: Sep. 22, 2006

(65) Prior Publication Data

US 2007/0068052 A1 Mar. 29, 2007

Related U.S. Application Data

(60) Provisional application No. 60/721,035, filed on Sep. 27, 2005.

(51) Int. Cl.
*G09F 1/00* (2006.01)

(52) U.S. Cl. ..... 40/124.191; 206/308.1; 229/92.8; 229/68.1

(58) Field of Classification Search ..... 40/124.06, 40/124.03, 124.191, 340; 206/308.1; D14/478; 229/92.8; 369/273
See application file for complete search history.

(56) References Cited

U.S. PATENT DOCUMENTS 5,775,492 A * 7/1998 Ban ..... 206/308.1
6,499,654 B1 * 12/2002 Huff et al. ..... 229/92.8
6,845,583 B2 1/2005 Lee
6,966,135 B1 11/2005 McDonald
2005/0087589 A1 * 4/2005 Liddell ..... 229/68.1
2005/0102867 A1 5/2005 Youngdahl

* cited by examiner

*Primary Examiner*—Paul N Dickson
*Assistant Examiner*—Shin Kim
(74) *Attorney, Agent, or Firm*—Mary A. Whiting, Esq.

(57) ABSTRACT

A device comprised of two flat layers of equal dimensions shaped like a postcard, for mailing a biodegradable organic video media item, such as a CD or DVD, integrated and embodied into its bottom layer, so as to create a greeting card. A picturesque scene is on its front cover related to the contents of the CD or DVD. The back cover has areas designated for greetings, instructions, recipient's address, and postage. The top and bottom layers are glued together. The glue is positioned so as not to contact the readable surface of the CD or DVD and degrade play. Once the top layer is separated from the bottom layer, the recipient can detach the CD or DVD from the bottom layer along outlines of the inner and outer perimeters of the CD's or DVD's shape, in order to play the CD or DVD.

16 Claims, 3 Drawing Sheets

VIDEO POSTCARD METHOD AND DEVICE

RELATED APPLICATIONS

This application claims priority from U.S. Provisional Application Ser. No. 60/721,035, entitled "Video postcard method and device", filed Sep. 27, 2005, which is hereby incorporated by reference in its entirety.

BACKGROUND

1. Field of Invention

The present invention relates to a method and device for sending to recipients though world wide posting services, video media items, such as video Compact Disks (CDs), or digital video devices (DVDs), (hereinafter referred to as "video media item(s) (CD(s) or DVD(s)") embodied into the structure of a postcard.

2. Description of the Prior Art

Several prior art devices disclose various tools for mailing video media items such as CDs or DVDs, through the world wide postal services enclosed in postcards or greeting cards, which include:

| Inventor | Pat. No. | Date |
|---|---|---|
| McDonald | U.S. Pat. No. 6,966,135 B1 | Nov. 22, 2005 |
| Youngdahl | US 2005/0102867 A1 | May 19, 2005 |
| Liddell | US 2005/0087589 A1 | Apr. 28, 2005 |
| Lee | U.S. Pat. No. 6,845,583 B2 | Jan. 25, 2005 |

These prior art devices are greeting cards which are containers for video media items (CDs or DVDs). The present invention is an improvement over these prior art devices since the present invention contains a video media item (CD or DVD) which is embodied into the structure of a postcard. The present invention is not a separate structure or container from the video media item (CD or DVD). The organic material comprising the present invention's video media item (CD and DVD) is made of the same organic material of the same thickness as the bottom layer of the postcard, which the video media item (CD or DVD) is embodied into.

For example, in McDonald, U.S. Pat. No. 6,966,135 B1, a conventional CD or DVD is inserted into a greeting card, which acts as a separate mailing container for the CD or DVD. The present invention differs from McDonald, since the organic video media item (CD or DVD) of the present invention is embodied into the present invention's structure, while McDonald's greeting card is a separate mailing container for conventional CDs or DVDs.

Youngdahl, US 2003/0182827A, has a different purpose and structure with many additional pieces, (such as a microphone, transducer, speakers, tracks), than the present invention. The present invention is a vast improvement over Youngdahl, since the present invention's video media item (CD or DVD), is integrated and embodied into the structure of the postcard, and no external devices are required. Also the bottom layer of the present invention which embodies the video media item (CD or DVD) is organic (biodegradable), and thus quite different from the materials of Youngdhal.

Liddell, US 2005/0087589 A1, forms a pocket wherein a conventional CD is slid inside. The present invention is improvement over Liddell, since the present invention's structure of the video media item (CD or DVD) and the bottom layer of the card is one and the same, no pocket is required to send the video media item (CD or DVD) to the recipient. Also the bottom layer of the present invention which embodies the video media item (CD or DVD) is organic (biodegradable), and thus quite different from the materials of Liddell.

Similarly, the present invention is also an improvement over Lee, U.S. Pat. No. 6,845,583 B2, since Lee only contains an audio message contained in a separate device. The present invention contains video (both audio and visual), and such video media item (CD or DVD) is embodied into the structure of the present invention. Also the bottom layer of the present invention which embodies the video media item (CD or DVD) is organic (biodegradable), and thus quite different from the materials of Lee.

OBJECTS AND ADVANTAGES

Accordingly, besides the distinctions from the prior art stated above, several objects and advantages of the present invention are:

To provide for a device wherein the video media item (CD or DVD), is contained in one easily transportable unit;

To provide for a device wherein video media items (CDs or DVDs) of varied sizes and shapes, are presented to the recipient in the form of a postcard or greeting card;

To provide for a device, wherein a top layer consisting of a film containing a scenic photographic image which is related to the contents of the video media item (CD or DVD) embodied into a bottom layer, which is mailed to a recipient, thus creating a video postcard or greeting card;

To provide for a device, wherein a greeting can be written on the non-readable surface of the video media item (CD or DVD), without degrading its performance;

To provide for a device, wherein the video media item (CD or DVD), is preferably made of an organic biodegradable product, recyclable and therefore environmentally responsible;

To provide for a device, wherein the device is relatively inexpensive to manufacture;

To provide for a device, wherein the structure of the device allows for the removal of the video media item (CD or DVD), from the postcard, without degradation of the readable surface of the video media item (CD or DVD); and To provide for a device, wherein the device is durable, not easily broken or fractured.

REFERENCE NUMBERS IN THE DRAWINGS

Figure 1:
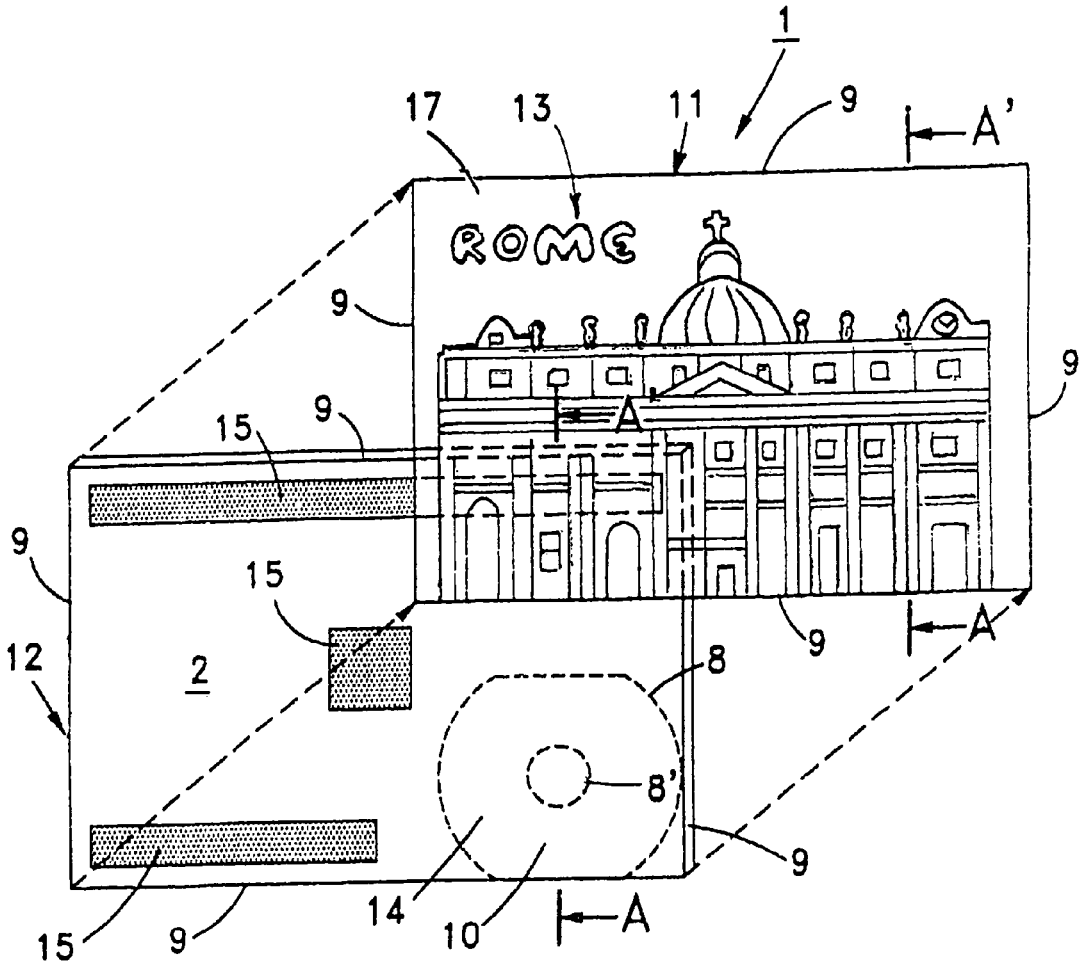
FIG. 1. is an exploded perspective top view showing a scenic picture on the front cover of the top layer; the front inner surface of the bottom layer (one comer shown in phantom), glue strips (shown partially in phantom), and readable surface within the perforated inner and outer perimeters of the video media item (CD or DVD).

1. device
2. front inner surface of bottom layer
3. back cover of bottom layer
4. greeting area
5. instructions area
6. postage area
7. address area
8. outer perimeter of video media item
8'. inner perimeter of video media item
9. edge of device
10. readable surface
11. top layer
12. bottom layer
13. picture
14. video media item
15. glue strip
16. back inner surface of the top layer
17. front cover of top layer
18. central line of demarcation

DETAILED DESCRIPTION AND SUMMARY OF THE INVENTION

This invention relates generally to a device for sending video media items, such as CDs or DVDs through the world wide postal service mail, in the form of a postcard. The video media item (CD or DVD) used in the present invention is comprised of organic material, which can be of a corn derivative, paper derivative, or other organic material. The postcard has a two layered structure, consisting of a top layer composed of a photographic film and a bottom layer composed of an organic material. Therefore, the video media item (CD or DVD) is integrated and embodied into the postcard's structure, since the postcard's bottom layer and the video media item (CD or DVD), are made of the same organic material, are of the same thickness, and are one and the same.

The device can be comprised of a common rectangular postcard, or any shape, such as a shell shape for a postcard sent from an ocean resort, or a triangular shape for a postcard sent from the pyramids of Egypt. An appealing scenic picture is illustrated on the front cover of the postcard. The back cover of the post card has areas for a greeting, instructions, recipient's address, and to affix proper postage.

The top and bottom layers of the postcard are attached to each other by glue strips or other common attachment means. The glue adheres to the inner surfaces of the top and bottom layers. The glue is positioned so as not to contact the readable surface and degrade the play of the video media item (CD or DVD).

Since the video media item (CD or DVD), and the bottom layer of the postcard which it is structurally embodied into, are made of the same organic material, and the top cover illustrates a scenic photograph, the entire device is thin, lightweight, and is no different in appearance, weight and use film any conventional postcard or greeting card.

The preferred embodiment of the present invention is comprised of: 1) a paper derivative product for video media items (CDs or DVDs), commonly called, "BLU-RAY" manufactured by Sony Kabushiki Kaisha, also known as Sony Corporation, Japan, or 2) an optical disk comprised of a corn derivative product, using polylactic acid, called "MildDisk" manufactured by Sanyo Electric Co, Ltd. These organic video media items (CDs and DVDs) are presently being introduced into the marketplace. Similarly, the present invention can be comprised of any other organic material for video media items (CDs or DVDs) offered to consumers in the marketplace.

The sender follows the instructions and writes a greeting, recipient's address, affixes a stamp, and mails the postcard. Once the recipient receives the postcard, after reading the instructions, and the greeting, the recipient removes the top layer with the photographic scene from the bottom layer of the postcard, being careful to detach the top and bottom layers along the strips of glue (or other common attachment means).

Removing the top layer uncovers the bottom layer of the device. The readable surface of the video media item (CD or DVD) is exposed on the front inner surface of the bottom layer. The user then follows the inner and outer outlines of the video media item, shown on the back cover of the bottom layer, to separate the video media item (CD or DVD) from the device. If the outlines are not perforated, the user cuts out the video media item (CD or DVD) from the bottom layer along these outlines of the inner and outer perimeters which follows the shape of the video media item (CD or DVD) which are printed on the back cover of the bottom layer. If these outlines of the inner and outer perimeters are perforated, (which perforations run through the structure of the bottom layer), the user separates the video media item (CD or DVD) from the device along these perforations.

Once the video media item (CD or DVD) is separated from the device, the recipient places the video media item (CD or DVD) into a suitable device or computer and play the video media item (CD or DVD). Since the content of the video media item (CD or DVD) is related to the scenic picture on the front cover of the device, it serves as a video postcard. The preferred running time of the video is short, about 5-10 minutes in length.

Prior art devices disclose postcards as separate containers for conventional video media items (CDs or DVDs). Conventional video media items (CDs or DVDs) are made of polycarbonate disks. Polycarbonate is light weight, strong, heat resistant and transparent, thus it was thought originally to be an ideal material for disks. However, a special facility is needed to generate the great heat necessary to burn and dispose of the conventional polycarbonate disks. This process gives concern to air pollution. Because conventional polycarbonate disks aren't biodegradable, they cause to pileup when buried in landfills.

The new forms of video media items (CDs and DVDs) made of organic materials are biodegradable, and also derived from a renewable resource. Therefore, the present invention is helpful to the environment since it is made of the same material as these new video media items (CDs and DVDs) that are more environmentally friendly.

The prior art greeting cards are made of a different material and structure than the video media items (CDs and DVDs). These prior art devices do not embody this organic video media device (CD or DVD) material into their structure and design, and therefore, do not have the distinct structure, use and advantages of the present invention.

In the preferred embodiment of the invention, the video media item (CD or DVD) is shaped with two flat sides, parallel to each other, and two mirror image curved sides. Round video media items (CDs or DVDs), or any other shapes which may be manufactured in the future, could also be embodied into an alternate embodiment of the invention.

The device is simple to use, easy to manufacture, and low cost. The present invention, is also environmentally responsible and recyclable. Therefore, professionals as well as laypersons will benefit from its use.

Moreover, other than being used for tourist related purposes, the postcard device can be used for many other uses, such as medical purposes, teaching purposes, and infinite other applications. In these applications, the picture on the front side of the device would be a picture that corresponds with the content of the video media item (CD or DVD), and the content of the message on the back cover of the device would be any content which the recipient would find useful and related to the content of the video media item (CD or DVD).

DESCRIPTION OF THE PREFERRED EMBODIMENT OF THE INVENTION

Figure 2:
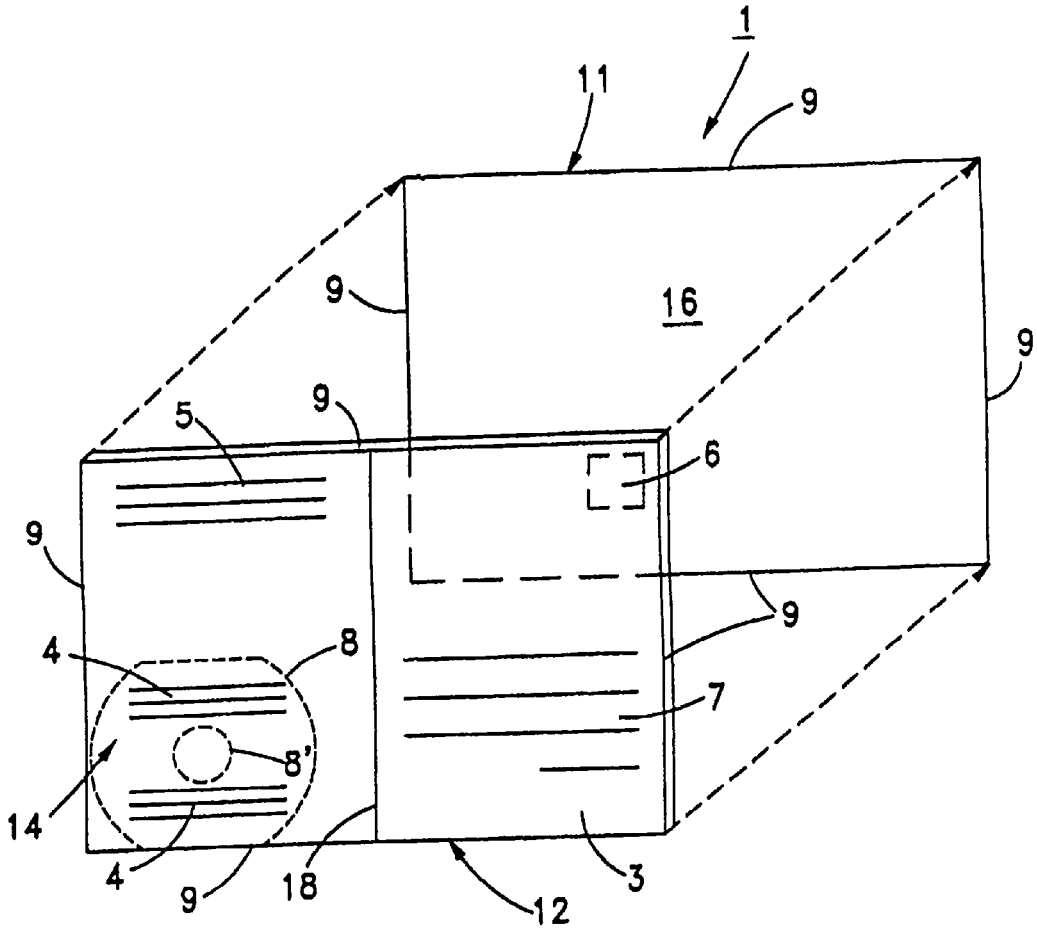
FIG. 2. is an exploded perspective bottom view showing the back cover of the bottom layer with areas designated for address, postage, greeting, instructions, central line of demarcation, and perforated outlines of the inner and outer perimeters of the video media item (CD or DVD), as well as the blank back inner surface of the top layer (with comer shown in phantom).

Referring to the drawings by numerals of reference, (FIGS. 1-3), this invention relates generally to a device 1 for sending organic biodegradable video media items 14 (such as CDs or DVDs) through the world wide postal service mail, in the format of a postcard. As shown in FIGS. 1 and 2, in the preferred embodiment of device 1, video media item 14 (CD or DVD), is shaped with two flat sides, parallel to each other, and two mirror image curved sides. In the center of the video media item 14 (outlined by inner perimeter 8') is an opening which secures the video media item 14 (CD or DVD) to the CD or DVD player machine. Round video CDs or DVDs (or any shape which may he manufactured in the future) could also he embodied into an alternate embodiment of the invention.

Figure 3:
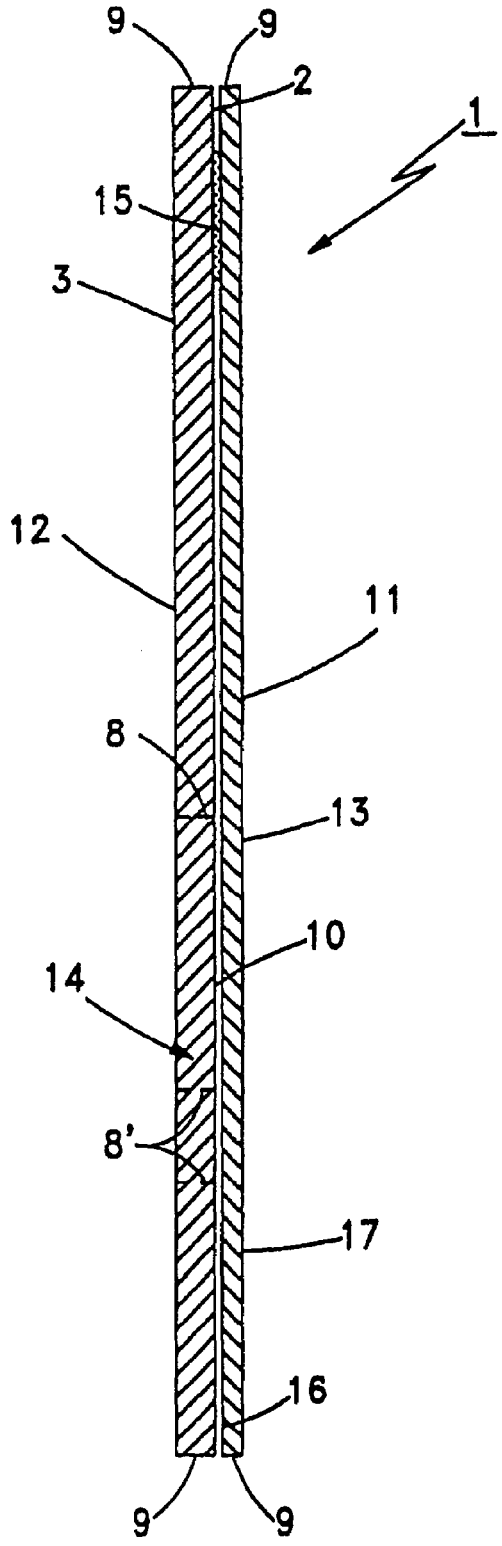
FIG. 3. is a cross-sectional view, along section A-A' shown in FIGS. 1 and 2, showing the top and bottom layers with glue strip between; and the bottom layer with perforations outlining the inner and outer perimeters of the video media item (CD or DVD), with a readable surface on the front inner surface of the bottom layer.

As shown in FIGS. 1-3, the device is comprised of two layers (a top layer 11 and a bottom layer 12). As shown in detail in FIG. 1, (a perspective top exploded view), top layer 11 consists of a front cover 17 comprised of a thin photographic film illustrated with a scenic picture 13. As shown in FIG. 2, top layer 11 has a blank back inner surface 16.

As shown in detail in FIG. 2, (a perspective bottom exploded view), bottom layer 12 consists of a back cover 3. Areas designated for instructions 5, greetings 4, address 7, and to affix postage 6 are on back cover 3. Video media item 14 (CD or DVD), is comprised of the same organic biodegradable material as bottom layer 12. Therefore, video media item 14 is integrated and embodied into the postcard's (device 1) structure.

As shown in FIG. 1, video media device's 14 readable surface 10 is on front inner surface 2 of bottom layer 12. As shown in FIG. 2, an outlines of the outer perimeter 8 and inner perimeter 8' of the video media item 14, are shown on back cover 3 of bottom layer 12. A scenic design matching the design 13 (as shown in FIG. 1), on front cover 17, may also be illustrated on back cover 3. The recipient can detach video media item 14 (DC or DVD) along perforations following outlines of outer perimeter 8 and inner perimeter 8'. If there are no perforations, the recipient can cut out video media item 14 (CD or DVD) from bottom layer 12 following outlines of outer perimeter 8 and inner perimeter 8'. Also on back cover 3, (as shown in FIG. 2), is a central line of demarcation 18 separating opposing sides of back cover 3.

As shown on FIG. 1, and further in detail in FIG. 3, (cross-section along section A-A'), top layer 11 and bottom layer 12 are attached along inner surfaces 16 and 2 (respectively), by a common glue strip means 15, placed so as not to come into contact with video media item's 14 readable surface 10, (shown in FIGS. 1 and 3). Inner perimeter 8' and outer perimeter 8, which outline the video media time 14 are shown in FIGS. 1-3.

As shown in FIGS. 1-3, when front inner surface 2 of bottom layer 12 is glued to back inner surface 16 of top layer 11, a smooth perimeter edge 9 outlining the shape of device 1 is formed, thus creating a postcard device 1 to be mailed safely in the postal services of various countries throughout the world. Commonly, as shown in FIGS. 1 and 2, device 1 is rectangular in shape, and perimeter edge 9 is a rectangle. Alternatively, device 1 can be of various artistic shapes, such as a shell shape for postcard from a ocean resort, or triangular in shape for a postcard from the pyramids of Egypt, among others.

As shown in FIG. 2, in order to use device 1, the sender fills in the designated areas for the address 7, and greeting 4 and places proper postage in designated area 6, and mails device 1 to a recipient. Once the recipient receives the postcard (device 1), after reading the instructions (in designated area 5) and the greeting (in designated area 4), the recipient removes top layer 11 from bottom layer 12, being careful to remove along glue strip means 15 (shown in FIG. 1), without degrading readable surface 10 of video media item 14 (CD or DVD), (shown in FIG. 1).

As shown in FIGS. 1 and 2, the recipient then separates video media item 14 (CD or DVD) from bottom layer 12 along outlines of outer perimeter 8 and inner perimeter 8' of video media item's 14 (CD's or DVD's) shape printed on back cover 3, (as shown in detail in FIG. 2). The user can either carefully cut video media item 14 (CD or DVD) out of bottom layer 12 along outlines of outer perimeter 8 and inner perimeter 8', or separate the video media item 14 (CD or DVD) along a perforation following outlines of outer perimeter 8 and inner perimeter 8', which runs through structure of bottom layer 12.

The recipient can then place video media item 14 (CD or DVD) into a suitable device or computer in order to play video media item 14 (CD or DVD). Since the contents of video media item 14 is related to the photographic film scene 13, (as shown in FIG. 1) it serves as a video postcard.

The invention claimed is:

1. A two layered postcard device presenting a video media item consisting of an organic biodegradable material to a recipient, comprising:

(a) a planar top layer comprising a front cover surface and a back inner surface of equal dimensions, with a photographic image on said front cover surface related to the contents of said video media item;

(b) a planar bottom layer consisting of said organic biodegradable material further comprising a front inner surface and a back cover surface of equal dimensions, with said video media item embodied into said bottom layer as an integral part of said bottom layer and of the same material composition and thickness of said bottom layer, with readable data surface of said video media item on said front inner surface of said bottom layer, and said back cover surface of said bottom layer containing outlines of equal dimensions to the inner and outer perimeters of said video media item, along which said video media item can be detached from said bottom layer, and designated spaces for instructions, recipient address, message, and postage, and (c) said back inner surface of said top layer is detachably attached to said front inner surface of said bottom layer by common glue means, whereby, once said video media item is so detached, said video media item can be played on a device manufactured for playing said video media item.

2. A device as described in claim 1, wherein perforations extend from said front inner surface to said back cover surfaces of said bottom layer and said perforations follow said outlines of said inner and outer perimeters of said video media item, whereby said video media item can be detached from said bottom layer along said perforations.

3. A device as described in claim 1, whereby said video media device can be detached from said bottom layer by cutting along said outlines of said inner and outer perimeters of said video media item.

4. A device as described in claim 1, wherein said top layer comprises a thin photographic film.

5. A device as described in claim 1, wherein the dimensions of said top and bottom layers are the same.

6. A device as claimed in claim 1, wherein said postcard device can be of a plurality of shapes, in order to match the contents of said video media item.

7. A device as claimed in claim 1, wherein said video media item may be of plurality of shapes and sizes, while remaining the same thickness as said bottom layer.

8. A device as claimed in claim 1, wherein a scenic image related to the contents of said video media item is illustrated on said back cover surface of said bottom layer.

9. A method for a sender to present to a recipient a video media item consisting of an organic biodegradable material in a two layered postcard device, comprising:

(a) a planar top layer comprising a front cover surface and a back inner surface of equal dimension, with a photographic image on said front cover surface related to the contents of said video media item;

(b) a planar bottom layer consisting of said organic biodegradable material further comprising a front inner surface and a back cover surface of equal dimensions, with said video media item embodied into said bottom layer as an integral part of said bottom layer and of the same material composition and thickness of said bottom layer, with readable data surface of said video media item on said front inner surface of said bottom layer, and said back cover surface of said bottom layer containing outlines of equal dimensions to the inner and outer perimeters of said video media item, along which said video media item can be detached from said bottom layer, and designated spaces for instructions, recipient address, message, and postage, and (c) said back inner surface of said top layer is detachably attached to said front inner surface of said bottom layer by common glue means, comprising the following steps:

(i) said sender reads said instructions, writes said recipient address, said message, and affixes said postage on said designated areas on said back cover surface of said bottom layer, and mails said postcard device to said recipient, and (ii) when said recipient receives said postcard, said recipient reads said message and said instructions, detaches said top layer from said bottom layer along said common glue means, and detaches said video media item embodied into said bottom layer along said outlines of said inner and outer perimeters of said video media item, Whereby said recipient plays said video media item on a device manufactured for playing said video media item.

10. A method as described in claim 9, wherein perforations extend from said front inner surface to said back cover surface of said bottom layer and said perforations follow said outlines of said inner and outer perimeters of said video media item, whereby said video media item can be detached from said bottom layer along said perforations.

11. A method as described in claim 9, whereby said video media device can be detached from said bottom layer by cutting along said outlines of said inner and outer perimeters of said video media item.

12. A method as described in claim 9, wherein said top layer comprises a thin photographic film.

13. A method as described in claim 9, wherein the dimensions of said top and bottom layers are the same.

14. A method as claimed in claim 9, wherein said device can be of a plurality of shapes, in order to match the contents of said video media item.

15. A method as claimed in claim 9, wherein said video media item may be of plurality of shapes and sizes, while remaining the same thickness as said bottom layer.

16. A method as claimed in claim 9, wherein a scenic image related to the contents of said video media item is illustrated on said back cover surface of said bottom layer.

* * * * *